US006128465A

United States Patent [19]

Castelli

[11] Patent Number: 6,128,465

[45] Date of Patent: Oct. 3, 2000

[54] MULTICOLOR TANDEM REPRODUCTION MACHINE HAVING A TRANSFIX-LIKE PRECONDITION ASSEMBLY

[75] Inventor: Vittorio Castelli, Yorktown Heights, N.Y.

[73] Assignee: Xerox Corporation, Stamford, Conn.

[21] Appl. No.: 09/411,215

[22] Filed: Oct. 4, 1999

[51] Int. Cl.[7] ..... G03G 15/00

[52] U.S. Cl. ..... 399/381; 399/390

[58] Field of Search ..... 399/381, 23, 390, 399/320, 307, 322, 299; 219/216; 347/102

[56] References Cited

U.S. PATENT DOCUMENTS

| | | | |
|---|---|---|---|
| 5,099,281 | 3/1992 | Bhagat | 399/390 |
| 5,200,285 | 4/1993 | Carrish | 399/307 |
| 5,500,667 | 3/1996 | Schwiebert et al. | 347/102 |
| 5,552,863 | 9/1996 | Genovese | 399/152 X |

*Primary Examiner*—Quana M. Grainger
*Attorney, Agent, or Firm*—Tallam I. Nguti

[57] ABSTRACT

An image reproduction machine is provided, and includes a paper substrate feeding assembly having a substrate path for feeding a portion of paper substrate; a moveable image bearing member having an imaging path; toner image forming devices along the imaging path for forming a toner image on the image bearing member; an image transfer station along the substrate path for transferring the toner image onto a portion of paper substrate fed by the paper substrate feeding assembly; and a toner image fusing assembly having heat and pressure devices for heating and fusing the toner image onto the portion of paper substrate. The reproduction machine importantly includes a blank paper substrate preconditioning apparatus (PSPA) for changing and stabilizing a size of the portion of paper substrate before it is fed to the image transfer station. The PSPA is mounted along the substrate path and upstream of the image transfer station relative to movement of the portion of paper substrate, and includes heat and pressure devices for preheating and pre-stressing the portion of paper substrate, thereby causing it to change size to an extent not alterable by subsequent application of heat and pressure within the toner image fusing assembly, thus resulting in highly registered quality reproduced toner images.

2 Claims, 1 Drawing Sheet

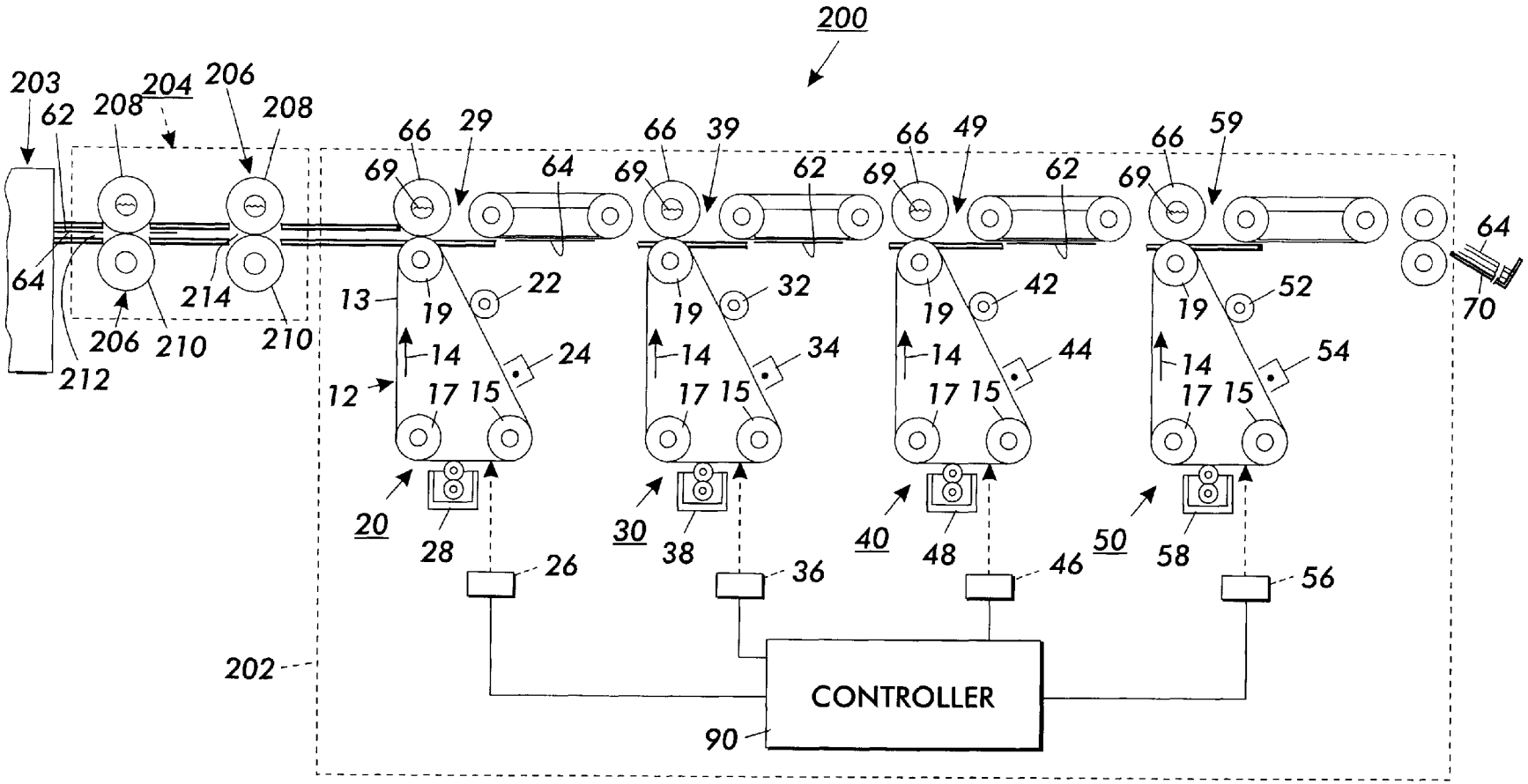
THE FIGURE

MULTICOLOR TANDEM REPRODUCTION MACHINE HAVING A TRANSFIX-LIKE PRECONDITION ASSEMBLY

BACKGROUND OF THE INVENTION

This invention relates generally to electrostatographic printing machines, and more particularly the invention is directed to a reproduction machine having a transfix-like preconditioning assembly for preheating and pre-stressing a copy sheet material in order to stabilize its size before it undergoes heat pressure stressing in image receiving and fusing transfix nips of the machine.

In an electrostatographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in irradiated areas. This records an electrostatic latent image on the photoconductive member corresponding to the informational areas contained within the original document being reproduced.

After the electrostatic latent image is recorded on the photoconductive member, the latent image is developed by bringing developer material containing charged toner particles, for example, black toner particles, into contact therewith. Developer material can be single component comprising only of charged toner particles, or it may be dual component comprising carrier particles and toner particles that are triboelectrically charged when admixed or mixed with the carrier particles. In either case, bringing the developer material into contact with the latent image forms a toner image on the photoconductive member, which is subsequently transferred to a copy sheet. The copy sheet is then separated from the photoconductive member and the toner powder is fed on the copy sheet through a fusing apparatus where it is heated to permanently affix it to the copy sheet, thus forming a black and white copy of the original document. Alternatively, the transfer and fixing steps can be performed simultaneously, usually by a combination of heat, pressure and electrostatic fields. This technique is called transfix.

Multi-color electrostatographic printing machines which use multi-colored toners are substantially identical in each color image forming process to the foregoing process of black and white printing which uses only black toner. However, rather than forming a single latent image on the photoconductive surface, several single color latent images corresponding to color separated light images of the original document are recorded thereon. Each single color electrostatic latent image is developed with toner particles of a color complementary thereto. This process may be performed in a single pass, or in multipasses during which image formation is repeated a plurality of cycles for differently colored images using their respective complementarily colored toner particles to form color toner images. The process may also be carried out in a tandem arrangement with each different color toner image being transferred in registration onto an intermediate transfer belt. Each single color toner powder image may also be transferred or transfixed as such onto a copy sheet in superimposed registration with the other toner powder images.

In a non-transfix machine, a composite multi-layered toner powder image is created and transferred onto a copy sheet. The copy sheet is then separated from the photoconductive member and. thereafter, the multi-layered toner powder image on the sheet is fed through a fusing apparatus and permanently affixed to the copy sheet, thus creating a color copy of the original multi-color document. In a black and white or multi-color electrostatographic printing machine, the copy sheet is typically brought into moving contact with the photoconductive member during toner powder image transfer to the copy sheet. In a non-transfix machine, a sheet transport apparatus is typically provided for receiving the copy sheet incrementally as it is incrementally separated from the photoconductive member, and for transporting the copy sheet towards and into a fusing apparatus where the toner powder image is heated in order to fuse and permanently affix the powder image to the copy substrate.

Unfortunately, it has been found that when copy sheet paper is subjected to the temperatures and pressures of fusing or transfixing apparatus in a multicolor tandem machines, the copy sheet of paper, and the image it might convey, tends to experience a significant change in size. This creates an image registration problem if subsequent separations of an image are transfixed to a paper copy sheet, inasmuch as their size will vary unpredictably.

SUMMARY OF THE INVENTION

According to one aspect of the present invention, there is provided an image reproduction machine that includes a paper substrate feeding assembly having a substrate path for feeding a portion of paper substrate; a moveable image bearing member having an imaging path; toner image forming devices along the imaging path for forming a toner image on the image bearing member; an image transfer station along the substrate path for transferring the toner image onto a portion of paper substrate fed by the paper substrate feeding assembly; and a toner image fusing assembly having heat and pressure devices for heating and fusing the toner image onto the portion of paper substrate. The reproduction machine importantly includes a blank paper substrate preconditioning apparatus (PSPA) for changing and stabilizing a size of the portion of paper substrate before it is fed to the image transfer station. The PSPA is mounted along the substrate path and upstream of the image transfer station relative to movement of the portion of paper substrate, and includes heat and pressure devices for preheating and pre-stressing the portion of paper substrate, thereby causing it to change size to an extent not alterable by subsequent application of heat and pressure within the toner image fusing assembly, thus resulting in highly registered quality reproduced toner images

BRIEF DESCRIPTION OF THE DRAWINGS

In the detailed description of the invention presented below, reference is made to the drawings in which:

The FIGURE is a vertical schematic of a multicolor tandem electrostatographic reproduction machine including a transfix-like preconditioning assembly in accordance with the present invention.

DETAILED DESCRIPTION OF THE INVENTION

Referring now to the FIGURE, a tandem multicolor electrostatographic reproduction machine is shown generally as 200, and includes a frame 202 and a number of toner imaging units, for example four units indicated generally by the reference numerals 20, 30, 40 and 50 which are positioned along a substrate path 62 of a portion of paper substrate 64, such as a sheet of paper. It is understood that although the plurality of toner imaging units is shown as four, any number of such toner imaging units will equally be acceptable, and is contemplated. In the embodiment illustrated, the toner portion of paper substrate is a cut sheet of paper, but it can equally be a portion of a continuous web of paper or of another substrate whose size is likely to change when subjected to heat and pressure in a fusing or transfixing nip.

The plurality of imaging units 20, 30, 40 and 50 may all employ the same marking or imaging technology, or they may employ several different and possible marking technologies, with the various different marking technologies necessitating different transfix steps with different required temperatures and pressures. In general, but not necessarily, as illustrated all units of a particular machine 200 will employ the same marking technology.

As illustrated, each toner imaging unit 20, 30, 40, 50, is substantially identical to the other, the only distinctions between the toner imaging units being their position along the substrate path 62, and the color of the toner and developer material employed therein. For example, toner imaging unit 20 uses cyan colored toner and developer material while units 30, 40, and 50 use magenta, yellow, and black colored toners and developer materials respectively. In as much as units 20, 30, 40 and 50 are similar, only unit 20 will be described here in detail.

At toner imaging unit 20, an endless photoconductive belt 12 having a photoconductive surface 13 is mounted over a plurality or rollers including rollers 15 and 17 and 19 for example, and rotates in the direction of arrow 14 to advance successive portions of the photoconductive surface 13 through various electrostatographic processing stations disposed about its path of movement thereof. Initially, a portion of the photoconductive surface 13 passes beneath a corona generating device 24, 34, 44, 54, which charges such portion to a relatively high, and substantially uniform electrical potential.

Next, the charged portion of the photoconductive surface 13 is advanced through an imaging station where a latent image is formed on the surface 13. At the imaging station, a controller, indicated generally by reference numeral 90, receives the image signals representing the desired output image and processes these signals to convert them to the various color separations of the image which is transmitted to a laser based output scanning device 26, 36, 46, 56 which causes the respective charge retentive surface 13 to be discharged in accordance with the output from the scanning device. Preferably the scanning device is a laser Raster Output Scanner (ROS). Alternatively, the ROS could be replaced by other xerographic exposure devices such as LED arrays.

The raster output scanner 26, 36, 46, 56 lays out the electrostatic latent image in a series of horizontal scan lines with each line having a specified number of pixels per inch. Preferably, the raster output scanner 26 employs a laser which generates a beam of light rays that are modulated by rotating polygon mirror blocks or solid state image modulator bars. Alternatively, the raster output scanner may use light emitting diode array write bars. In this way, an electrostatic image is recorded on the photoconductive surface of belt 12.

The charged portion of the photoconductive surface 13 with a latent image thereon next is moved to a development unit 28, 38, 48, 58, which contains and applies appropriately charged toner and developer material of a desired color, for example cyan toner and developer material in the case of toner imaging unit 20, to the latent image. The particular color of toner and developer material of course is different for each of the toner imaging units 20, 30, 40, 50, as explained above. As shown, for each toner imaging unit 20, 30, 40 and 50, after the latent image has been developed by development unit 28, 38, 48, 58, as above into a toner image, for example cyan toner in the case of toner imaging unit 20, the toner image is next moved to a transfer or transfix station shown generally as 29, 39, 49, 59.

At transfix station 29, 39, 49, 59, the toner image is transferred and simultaneously heated and fused within a heat and pressure nip 60, onto the toner portion of paper substrate 64, such as a copy sheet of paper. As further shown, each heat and pressure transfix nip 60 is formed in part by one of the belt support rollers, roller 19 against the photoconductive surface 13 of the belt 12, with a back up roller 66. As further illustrated, the heat for each heat and pressure transfix nip 60 may be provided by a heating device 69 within the backup roller 66, for simultaneously heating, transferring and fixing the toner image onto the portion of paper substrate or sheet 64.

Accordingly, a cyan toner image is formed as such by toner imaging unit 20, a magenta toner image is similarly formed by toner imaging unit 30, a yellow toner image is similarly formed by toner imaging unit 40, and a black toner image is similarly formed by toner imaging unit 50, and transfixed onto a sheet 64 (in superimposed registration at units 30, 40 and 50) with the toner image previously formed and transfixed, for example at unit 20.

After all of the different color toner images have been formed and transferred or transfixed in registration as above, the substrate or copy sheet 64 is advanced to catch tray 70 for subsequent removal from the printing machine by the operator.

Residual toner and developer material remaining or adhering to the continuous transfer belt 12 after transfixing of its toner image is removed for example at a cleaning station by a cleaning device 22, 32, 42, 52. Cleaning device 22, 32, 42, 52 may comprise a cleaning roller, formed of any appropriate synthetic resin driven in a direction opposite to the direction of movement of continuous transfer belt 12 so as to scrub the surface thereof clean. To assist in this action, carrier may be fed through a pipe onto the surface of the cleaning roller. A wiper blade may also be used to complete the cleaning of the surface of belt 12 in preparation for receiving another multicolor as above.

As further illustrated, the tandem multicolor electrostatographic reproduction machine 200 importantly includes a blank paper substrate preconditioning apparatus (PSPA) 204 for changing and stabilizing a size of the portion of paper substrate 64 before it is fed to the image transfer assembly or transfix station 29, 39, 49, 59 of the plurality of toner image forming units 20, 30, 40 and 50. The paper substrate preconditioning apparatus (PSPA) 204 is mounted along the substrate path 62 and upstream of the image transfer assemblies or transfix stations 29, 39, 49, 59, relative to movement of the portion of paper substrate or copy sheet 64. Importantly, the paper substrate preconditioning apparatus (PSPA) 204 includes heat and pressure means, shown generally as 206, for preheating and pre-stressing the portion of paper substrate 64, thereby causing it to change size to an extent not alterable by subsequent heat and pressure within the toner image fusing assemblies or transfix stations 29, 39, 49, 59. The heat and fixing or pressure means 206 for example may comprise a single fuser-like or transfix-like apparatus including a heated fuser roller 208 and a pressure roller 210 forming a paper preconditioning nip 212. However, in a tandem multicolor reproduction machine with multiple transfix stations that will subject the same copy sheet or portion of paper substrate to heat and pressure, the heat and pressure means 206 preferably comprises a pair of fuser-like or transfix-like assemblies that each include a heated fuser roller 208 and a pressure roller 210 forming paper preconditioning nips 212 and 214. The result is highly registered quality reproduced toner images.

In operation, a portion of paper substrate 64, such as a cut sheet of paper, is fed from a blank paper substrate supply 203 along the substrate path 62 into the paper substrate preconditioning apparatus (PSPA) 204 of the present invention. Within the paper substrate preconditioning apparatus (PSPA) 204, the portion of paper substrate 64 is passed through at least one fuser-like or transfix-like nip 212, and preferably as shown through a second such nip 214 for preheating and pre-stressing the portion of paper substrate 64, thereby causing it to change size to an extent not alterable by subsequent application of heat and pressure within the toner image fusing assemblies or transfix stations 29, 39, 49, 59.

Specifically, within the nip(s) 212, 214, the heated fuser roller 208 and pressure roller 210 preheat and pre-stress (thus preconditioning) the portion of paper substrate 64, thus causing it to change size to an extent that is not going to be altered by subsequent heat and pressure fusing or transfixing operations. Such preconditioning advantageously solves major color-to-color and image-to-paper registration problems, resulting in a relatively much highly registered quality composite multicolor toner image.

Such preconditioning works because when a copy substrate, particularly paper, is subjected within the nips 212, 214, to pressures in the range of a few hundred pounds per square inch, and heat at temperatures near and beyond 100 degrees Celsius, even for a brief time, dimensional changes or size changes take place in the paper. The reasons for this include the facts that (a) states of stress which were locked in the portion of paper substrate 64 during paper manufacturing are released; (b) water is extracted from the paper; (c) cycling the moisture content of the paper produces hysteretical size changes; and (d) paper has a finite thermal coefficient of expansion.

The change in size of the portion of paper substrate 64 occurs during the brief time it is in the fuser-like or transfix-like nips 212, 214. The portion of paper substrate 64 starts a relaxation process immediately thereafter. This relaxation process is mainly due to water re-adsorption and to temperature changes. Ordinarily, the time constraints for these changes are rather slow, and in the order of minutes. As a consequence, color-to-color toner image registration, and toner image-to-paper registration ordinarily will be affected because they rely on reproducible processes, whereby images of s a fixed size are superposed either on other images (separations) or on a sheet of paper such as the portion of paper substrate 64. Therefore, if the dimensions or size of the portion of paper substrate 64 are not stable and do not remain constant by the time it is fed through the various transfix stations 29, 39, 49 and 59, each such registration will be detrimentally affected. The paper substrate preconditioning apparatus (PSPA) 204 of the present invention advantageously preconditions the portion of paper substrate 64 and thus provides such size stabilization, prevents such detrimental effects on each such registration.

As illustrated such preconditioning of the portion of paper substrate 64 consists of passing it through a sufficient number of transfix-like stations or nips 212, 214 so that it achieves a desired temperature for the subsequent transfix stations 29, 39, 49, 59, and, therefore, is no longer inclined to undertake changes in dimensions. This is true where the portion of paper substrate is a cut sheet fed directly or escorted, or where it is merely part of a continuous web of paper.

As can be seen, there has been provided an image reproduction machine that includes a paper substrate feeding assembly having a substrate path for feeding a portion of paper substrate; a moveable image bearing member having an imaging path; toner image forming devices along the imaging path for forming a toner image on the image bearing member; an image transfer station along the substrate path for transferring the toner image onto a portion of paper substrate fed by the paper substrate feeding assembly; and a toner image fusing assembly having heat and pressure devices for heating and fusing the toner image onto the portion of paper substrate. The reproduction machine importantly includes a blank paper substrate preconditioning apparatus (PSPA) for changing and stabilizing a size of the portion of paper substrate before it is fed to the image transfer station. The PSPA is mounted along the substrate path and upstream of the image transfer station relative to movement of the portion of paper substrate, and includes heat and pressure devices for preheating and pre-stressing the portion of paper substrate, thereby causing it to change size to an extent not alterable by subsequent application of heat and pressure within the toner image fusing assembly, thus resulting in highly registered quality reproduced toner images.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed is:

1. A multicolor reproduction machine comprising:

(a) a blank paper substrate supply and feeding assembly including a substrate path;

(b) a plurality of toner image forming units mounted to a frame along said substrate path, and each including:

(i) a movable photoreceptor having a charge bearing surface;

(ii) a charging device for applying a uniform layer of charge onto said charge bearing surface;

(iii) an exposure device for image-wise dissipating charge from selected portions of said uniformly charged surface to electrostatically form a color separation latent image on said charge bearing surface; and (iv) a development apparatus for applying developer material including charged toner particles of a corresponding color onto the color separation latent image so as to form a toner color separation image of a final multicolor toner image; and (v) a transfix assembly for transferring and fusing the toner color separation image in registration from said photoreceptor onto a portion of paper substrate being fed along said substrate path; and (c) a blank paper substrate preconditioning apparatus (PSPA) for changing and stabilizing a size of the portion of paper substrate before it is fed to said image transfix assembly of each toner image forming unit of said plurality of toner image forming units, said PSPA being mounted along said substrate path and upstream of each said transfix assembly, relative to movement of the portion of paper substrate, and said PSPA including a pair of heat and pressure roller nips arranged in series for preheating to a temperature of at least 100 degrees Celsius, and pre-stressing, the portion of paper substrate to an extent that will not be altered by subsequent heat and pressure within each said image transfix assembly, thus resulting in highly registered quality reproduced toner images.

2. The image reproduction machine of claim 1, wherein said blank paper substrate preconditioning apparatus (PSPA) comprises a heated fuser roller and a pressure roller forming a paper preconditioning nip.

* * * * *